US008496343B2

(12) United States Patent
Lee

(10) Patent No.: US 8,496,343 B2
(45) Date of Patent: Jul. 30, 2013

(54) WALKING STICK STRUCTURE WITH AN LED LIGHT INSIDE THE STICK BODY

(76) Inventor: Ming-Hsien Lee, DongGuan (CN)

( * ) Notice: Subject to any disclaimer, the term of this patent is extended or adjusted under 35 U.S.C. 154(b) by 0 days.

(21) Appl. No.: 13/310,043

(22) Filed: Dec. 2, 2011

(65) Prior Publication Data

US 2013/0141899 A1 Jun. 6, 2013

(51) Int. Cl.
*A45B 3/02* (2006.01)

(52) U.S. Cl.
USPC ..... 362/102; 362/217.02; 362/217.05; 362/217.1; 362/234; 362/577; 135/65; 135/66; 135/910

(58) Field of Classification Search
USPC ..... 362/102, 217.01, 217.02, 217.05, 362/217.1, 234, 296.01, 577, 800; 135/65, 135/910, 66
See application file for complete search history.

(56) References Cited

U.S. PATENT DOCUMENTS 5,331,990 A * 7/1994 Hall et al. ..... 135/65
5,351,704 A * 10/1994 Hunnicutt et al. ..... 135/66
5,582,196 A * 12/1996 Hae et al. ..... 135/65
5,588,735 A * 12/1996 Harada ..... 362/102
6,330,888 B1 * 12/2001 Aravantinos et al. ..... 135/66
6,745,786 B1 * 6/2004 Davis ..... 135/65
6,772,778 B2 * 8/2004 Morosini et al. ..... 135/65
7,784,479 B2 * 8/2010 Navarro ..... 135/66
2002/0189657 A1 * 12/2002 Yuan ..... 135/65
2008/0072940 A1 * 3/2008 Cheng et al. ..... 135/66

* cited by examiner

*Primary Examiner* — Stephen F Husar
*Assistant Examiner* — Meghan Dunwiddie
(74) *Attorney, Agent, or Firm* — Egbert Law Offices, PLLC

(57) ABSTRACT

A walking stick structure with an LED light inside the stick body has a holding part, a footing, joint holding parts, LED illumination components, and reflecting devices. The stick body is a highly translucent glass fiber inner tube with combination of a hollow external tube, and the hollow external tube is configured with a plurality of translucent parts. A battery seat and a battery are provided. The LED illumination component is connected on either end of the battery seat, and the battery seat is combined with a switch to turn on/off the LED illumination component. The reflecting device is configured inside the glass fiber inner tube and opposite to the irradiation direction of the LED. The light beams from the LED can be reflected by the reflecting device and go out from the translucent parts. Thus, the intensity and scope of illumination is considerably enhanced.

7 Claims, 8 Drawing Sheets

WALKING STICK STRUCTURE WITH AN LED LIGHT INSIDE THE STICK BODY

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a body assisting and supporting product, and more particularly to an innovative walking stick with an LED light.

2. Description of Related Art Including Information Disclosed Under 37 CFR 1.97 and 37 CFR 1.98.

Generally, walking stick users are old-aged or handicapped people who have movement problems or can only walk slowly. When the walking stick user is walking at night or on a road with heavy traffic and poor illumination, traffic accidents may easily happen because the user can not see the road conditions clearly or the drivers can not clearly judge the movement of the user due to the bad illumination. Further, mountain climbers may also use a hiking stick to alleviate the burden on the body and to improve security. But in the mountains, the weather changes quickly, and the user may often encounter dark environments and get lost. Therefore, it is very important for a walking stick to have the function of illumination.

Traditional walking sticks with illumination function are commonly comprised of wooden, plastic or metal material. Because such materials are mostly not translucent and the illumination components are old-styled lamps, the scope and intensity of illumination is usually not sufficient. A prior-art walking stick may alternatively be configured with an electric circuit, but the complex structure leads to high production cost. Moreover, the illumination components on a prior-art walking stick are mostly configured outside the stick body, and therefore may easily get damaged because of contact with liquid (for example, when used in a rainy weather) or impact of external force.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The present invention is comprised of a stick body, a holding part, a footing, joint holding parts, LED illumination components, and reflecting devices. The stick body adopts an innovative and unique design with the combination of a highly translucent glass fiber inner tube and a hollow external tube. Compared to the prior-art, the present invention can considerably increase the illumination intensity and scope by adopting the LED illumination components and a highly translucent glass fiber inner tube. Moreover, as the power supplying part is only a combination of a battery seat and battery, the simple structure ensures low production cost and reduced production processes. Further, as the LED illumination component and battery seat are configured inside the stick body, the product has a good waterproof property. The present invention has a number of practical advancements and good industrial application effect.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

FIGS. 1 to 8 depict a preferred embodiment of the walking stick structure with an LED light inside the stick body of the present invention. However, such an embodiment is illustrative only, and is not intended to be limiting to the scope of patent application.

Figure 1:
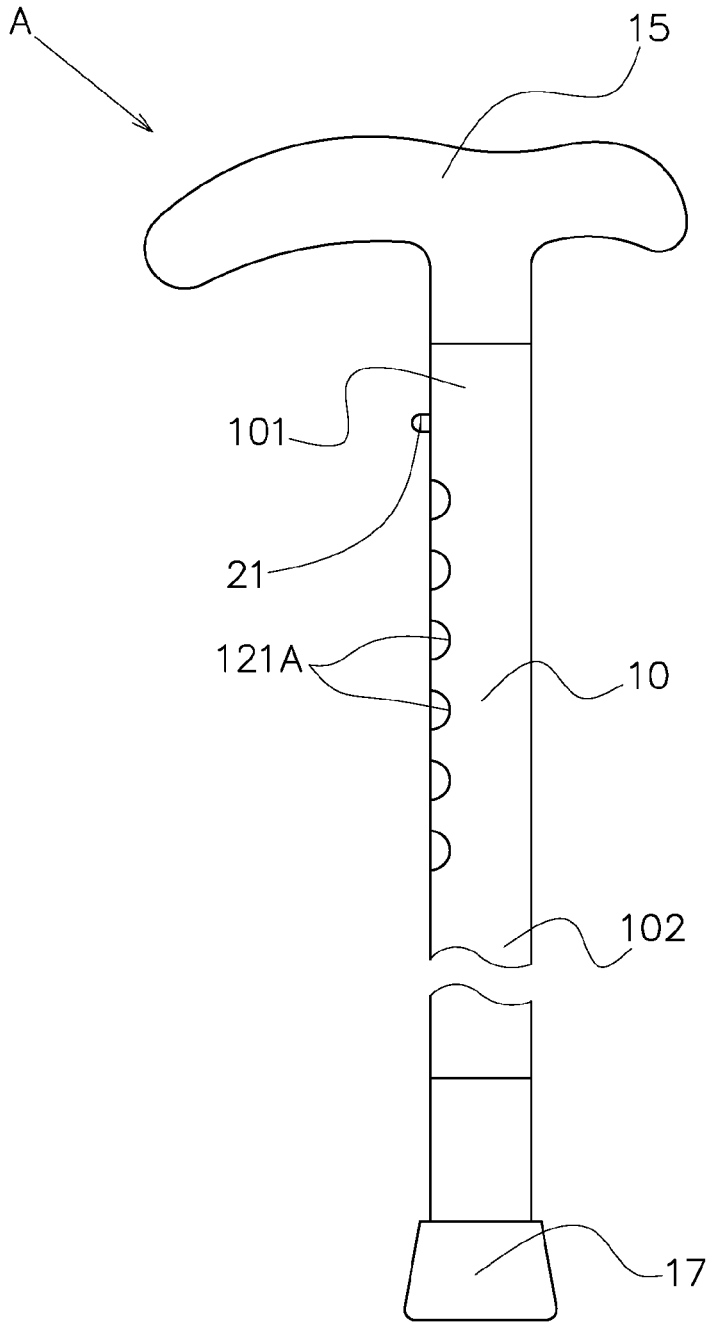
FIG. 1 is a plan side view of the present invention.
Figure 8:
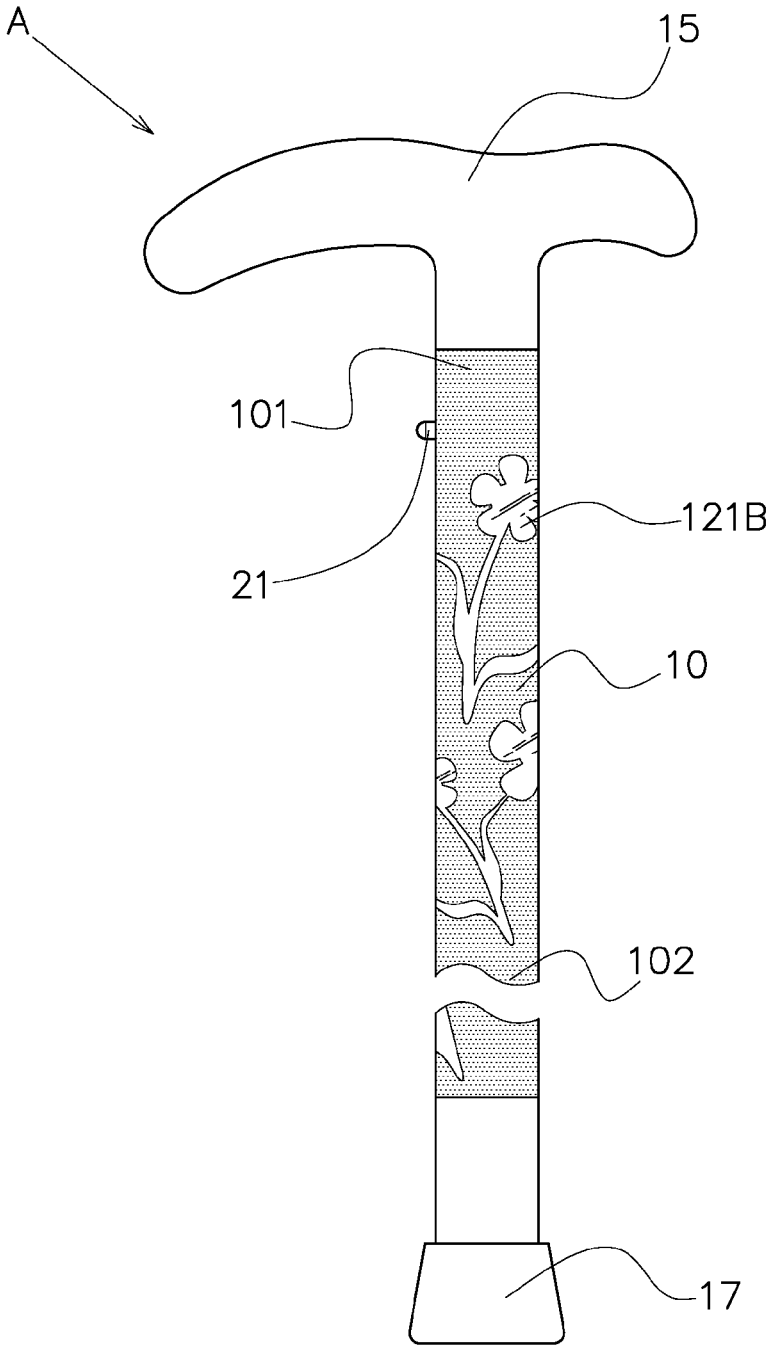
FIG. 8 is a schematic view of an embodiment of the present invention with configuration of translucent graphic designs on the surface of the hollow external tube.

Said walking stick structure with an LED light inside the stick body comprises the following structures. FIGS. 1 to 4 depict a stick body 10, which is comprised of a highly translucent glass fiber inner tube 11 with combination of a hollow external tube 12 (only indicated in FIGS. 4 and 5). The hollow external tube is configured with a plurality of translucent parts. The translucent parts can be loop holes 121A (as indicated in FIG. 1) or translucent graphic designs 121B (as indicated in FIG. 8). Moreover, the top end 101 and the bottom end 102 of the stick body 10 are configured with an upper joining part 13 and a lower joining part 14.

A holding part 15 is provided for the user to grip, which extends downward and forms a first connecting part 16. The first connecting part 16 is to combine with the upper joining part 13 on the top end 101 of the stick body 10.

A footing 17 is provided which extends upward and forms a second connecting part 18. The second connecting part 18 is to combine with the lower joining part 14 on the bottom end 102 of the stick body 10.

Figure 2:
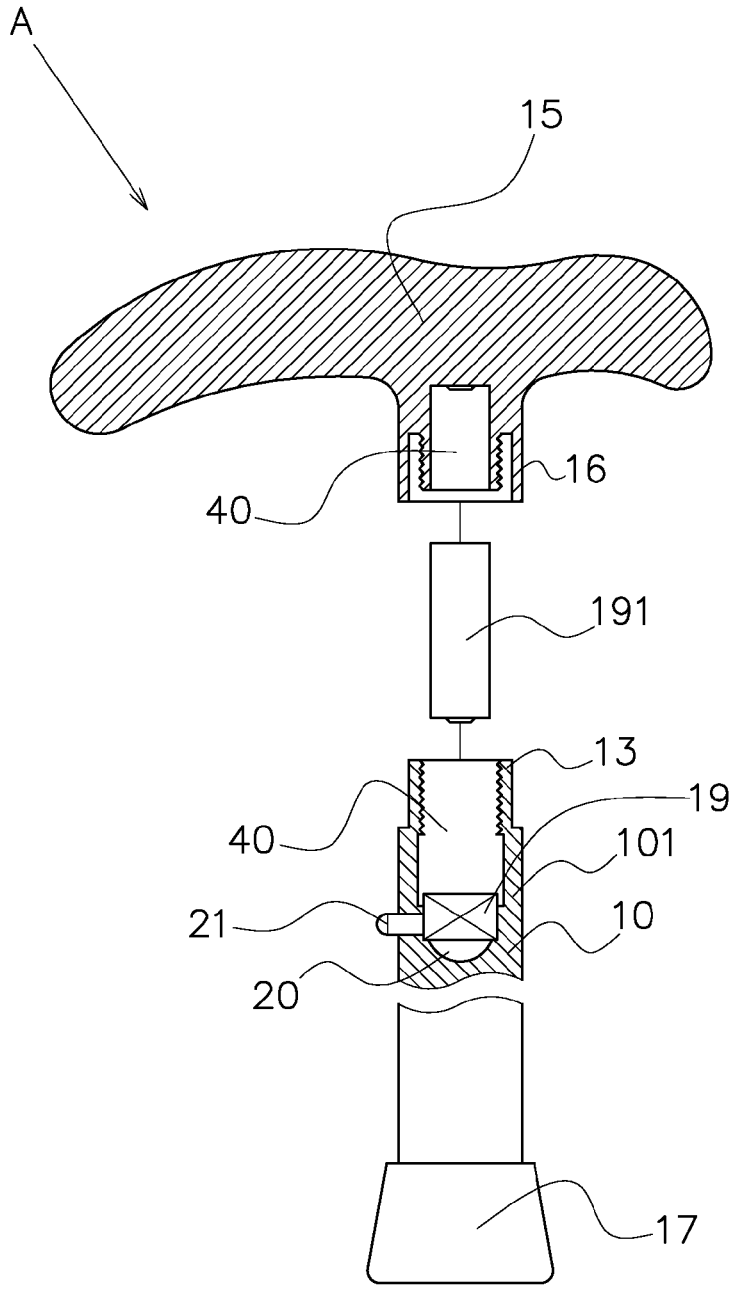
FIG. 2 is an exploded sectional view of the joint holding part of the present invention configured between the upper joining part and first connecting part.
Figure 3:
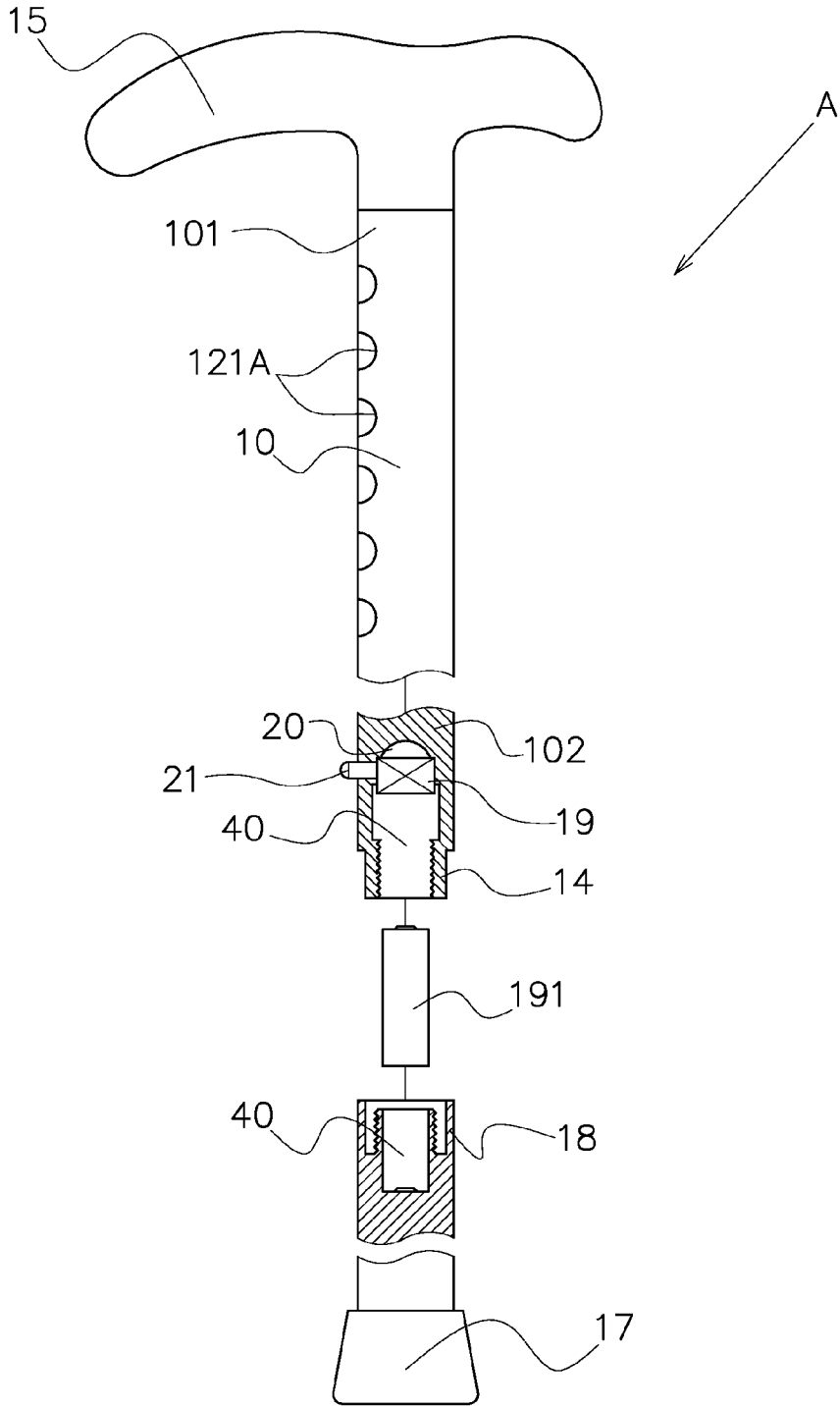
FIG. 3 is an exploded sectional view of the joint holding part of the present invention configured between the lower joining part and second connecting part.
Figure 4:
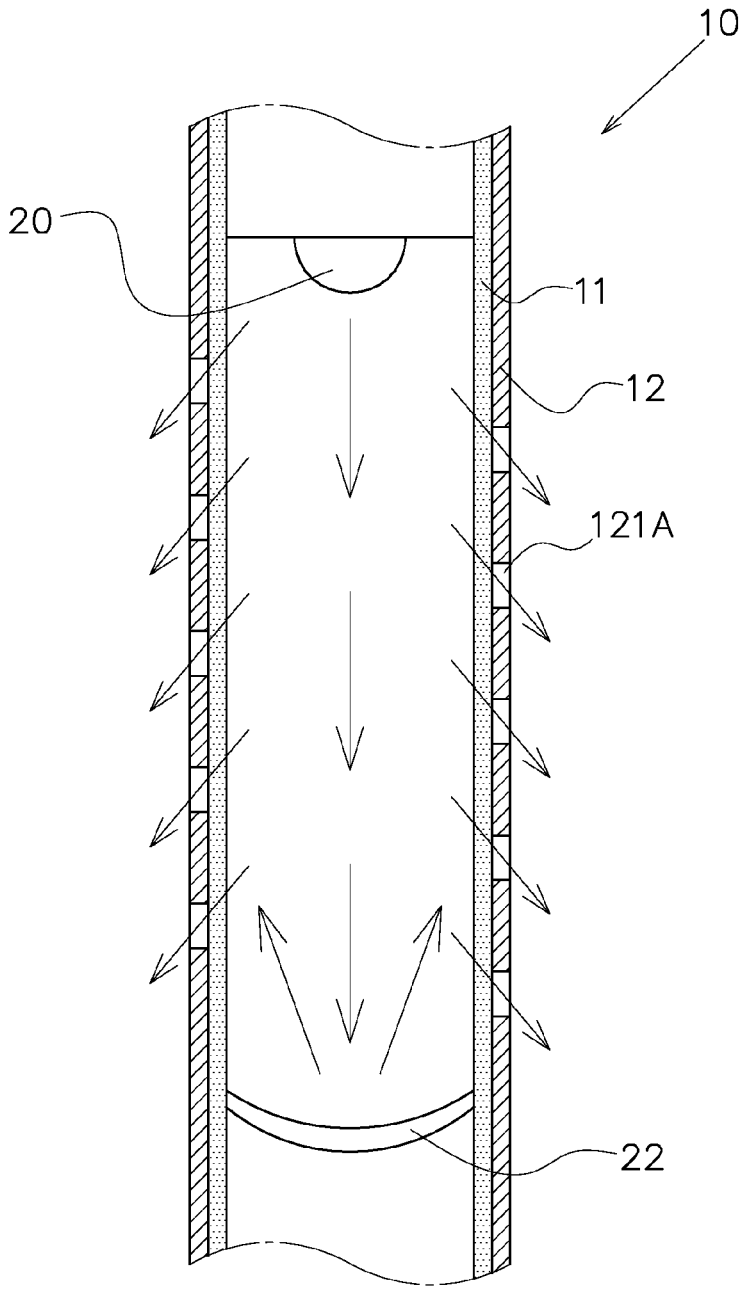
FIG. 4 is a schematic view of the LED illumination component of the present invention irradiating on the reflecting device.

Joint holding parts 40, as shown in FIGS. 2 and 3, are configured between the upper joining part 13 and the first connecting part 16 or between the lower joining part 14 and the second connecting part 18, for configuration of a battery seat 19 and a battery 191.

An LED illumination component 20 is connected to either side of the battery seat 19. The battery seat 19 is combined with a switch 21 to turn on/off the LED illumination component 20.

A reflecting device 22 is configured inside the glass fiber inner tube 11 and opposite to the irradiation direction of the LED illumination component 20.

Through such a structure, the light beams from the LED illumination component 20 can be reflected by the reflecting device 22 and go out from the translucent parts 121A and/or 121B for an illumination effect of the walking stick A. Such translucent parts 121A and/or 121B can be arranged, according to the users' need, in specific styles (not shown in the drawing).

Figure 5:
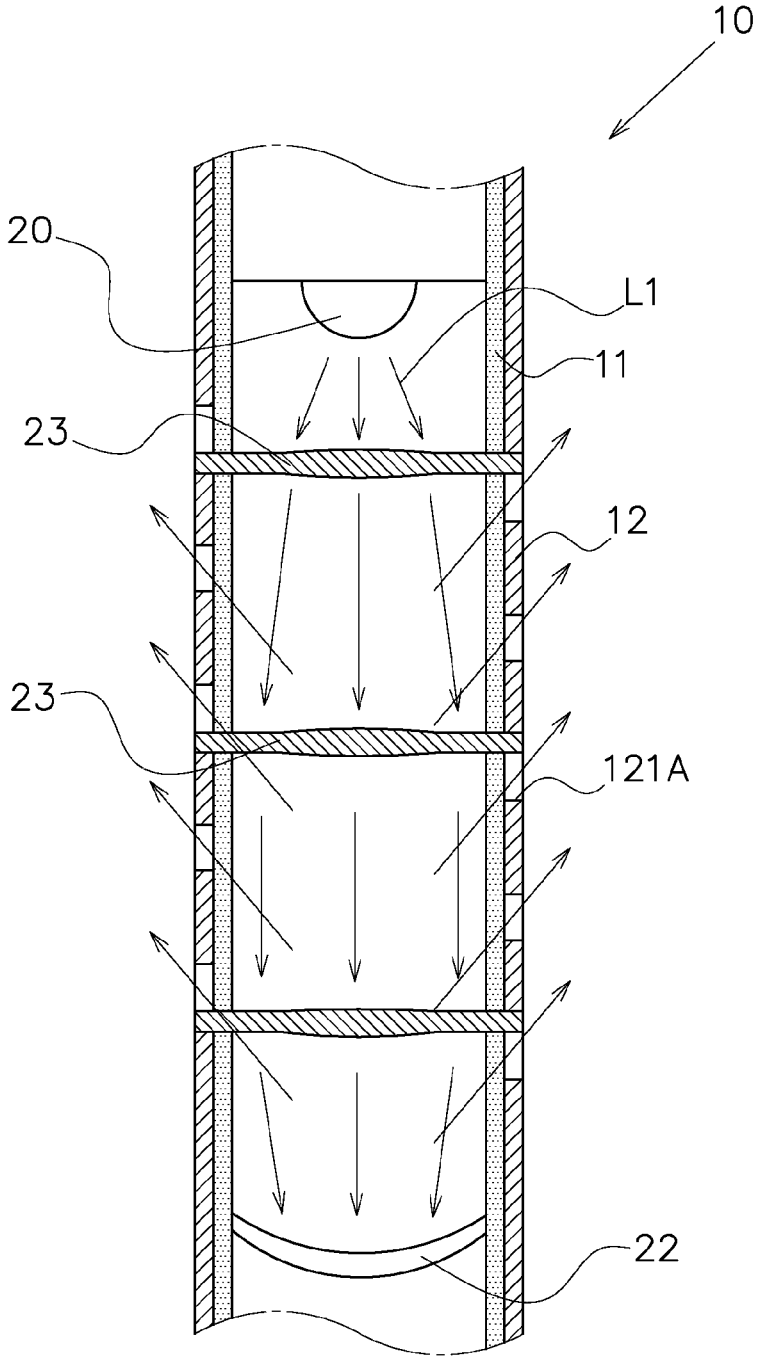
FIG. 5 is a schematic view of the LED illumination component of the present invention irradiating on the reflecting device through the transverse condensing board.

Referring to FIG. 5, a plurality of transverse condensing boards 23 are configured between the LED illumination component 20 and the reflecting device 22, so that when the LED illumination component 20 emits light beams L1, the light beams L1 will be further condensed when they go through the condensing board 23.

As indicated in FIGS. 2 and 3, the upper joining part 13 and first connecting part 16, as well as the lower joining part 14 and second connecting part 18 are connected through male and female threads.

Figure 6:
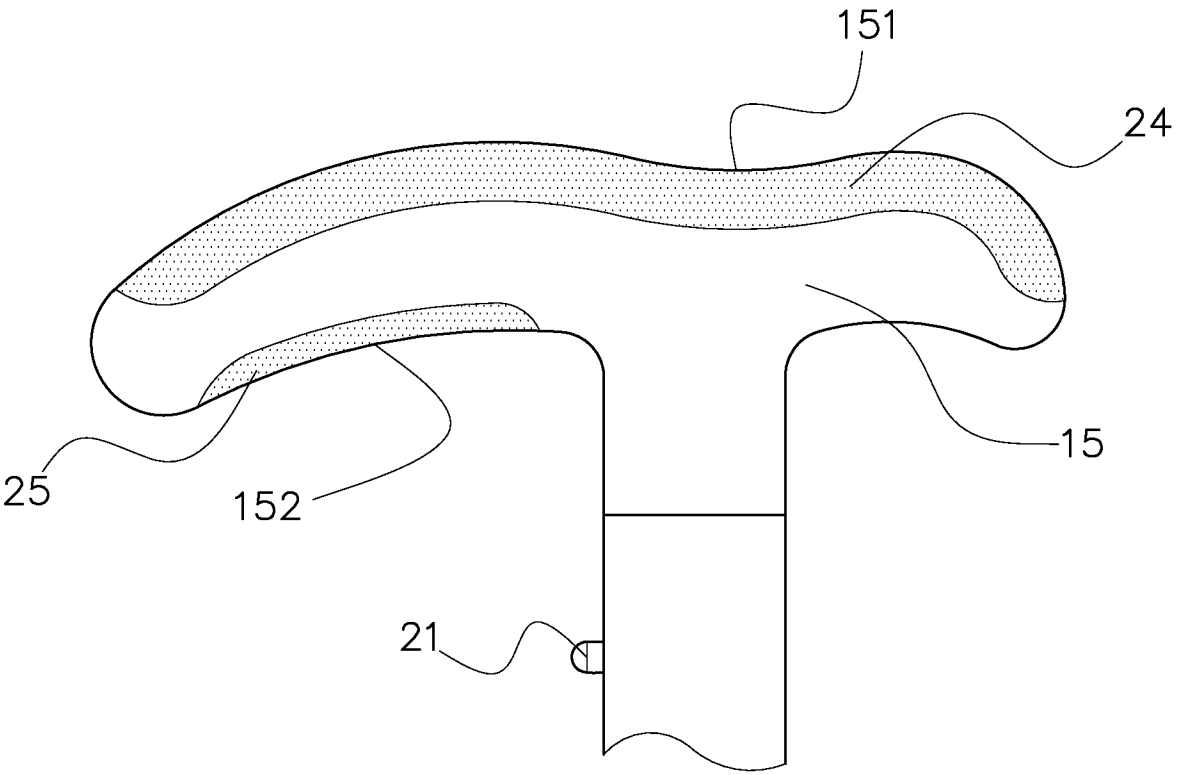
FIG. 6 is a schematic view of an embodiment of the present invention with the upper and lower surface of the holding part configured with an imitation leather layer and thermoplastic elastomer layer.
Figure 7:
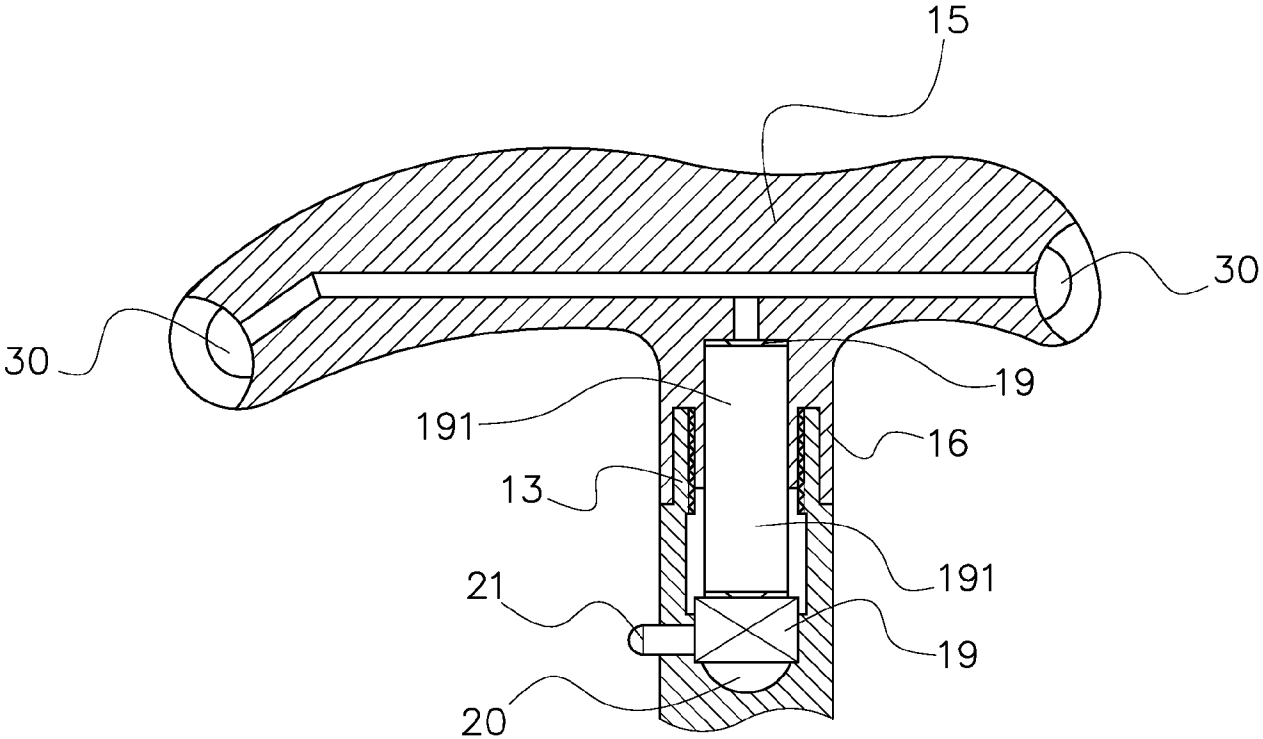
FIG. 7 is a schematic view of an embodiment of the present invention with the front and rear end of the holding part further configured with illumination devices.

Referring to FIG. 6, the upper surface 151 of the holding part 15 is covered with an imitation leather layer 24, and its lower surface 152 is configured with a thermoplastic elastomer layer 25, so as to provide anti-skid and wear-resistant functions as well as comfort grip. Referring to FIG. 7, the front and rear ends of the holding part 15 are further configured with illumination devices 30. Such illumination devices 30 are connected to the battery seat 19 for illumination. Such illumination devices 30 can enhance the scope and intensity of illumination in the front and rear direction so as to increase safety.

As a supplement to the above description, the hollow external tube 12 is a carbon fiber tube. Or, the hollow external tube 12 can also be a highly translucent glass fiber tube so that the stick body is comprised of two layers of glass fiber. The inner glass fiber layer can be thicker than the outer glass fiber layer so as to enhance the strength of the whole structure. Referring to FIG. 8, the surface of the hollow external tube 12 can be configured with translucent graphic designs 121B, and on the surface beyond the translucent graphic designs 121B, a dark-color (for example, black or dark brown) material can be used, so that the illumination of the stick body 10 can meet the demand of the user.

I claim:

1. A walking stick apparatus comprising:

a stick body formed of a translucent glass fiber inner tube and a hollow external tube, said hollow external tube having a plurality of translucent parts, said stick body having an upper joining part at a top end thereof and a lower joining part at a bottom end thereof;

a holding part suitable for grasping by a user, said holding part extending downwardly so as to form a first connecting part, said first connecting part connected to said upper joining part;

a footing extending upwardly so as to form a second connecting part, said second connecting part connected to said lower joining part;

a plurality of joint holding parts positioned between said upper joining part and said first connecting part or between said lower joining part and said second connecting part so as to form a battery seat and receive a battery;

an LED illumination component connected to either side of said battery seat, said battery seat having a switch suitable for turning said LED illumination component on and off; and a reflecting device positioned within said glass fiber inner tube and opposite to an irradiation direction of said LED component, said LED illumination component suitable for projecting light so as to be reflected by said reflecting device and to pass through said translucent parts so as to create an illumination effect.

2. The walking stick apparatus of claim 1, further comprising:

a plurality of transverse condensing boards positioned between said LED illumination component and said reflecting device.

3. The walking stick of claim 1, said upper joining part being threadedly connected to said first connecting part, said lower joining part being threadedly connected to said second connecting part.

4. The walking stick of claim 1, said hollow external tube being a carbon fiber tube.

5. The walking stick of claim 1, said hollow external tube being a translucent glass fiber tube.

6. The walking stick of claim 1, said inner tube having a thickness greater than a thickness of said hollow external tube.

7. The walking stick of claim 1, said hollow external tube having a graphic design thereon.

* * * * *